US008167418B2

(12) United States Patent
Jones

(10) Patent No.: US 8,167,418 B2
(45) **Date of Patent: *May 1, 2012**

(54) METHOD OF FEEDING SOLID INK STICKS INTO AN INK LOADER OF A PHASE CHANGE INK PRINTER

(75) Inventor: Brent Rodney Jones, Sherwood, OR (US)

(73) Assignee: Xerox Corporaiton, Norwalk, CT (US)

( * ) Notice: Subject to any disclaimer, the term of this patent is extended or adjusted under 35 U.S.C. 154(b) by 360 days.

This patent is subject to a terminal disclaimer.

(21) Appl. No.: 12/606,942

(22) Filed: Oct. 27, 2009

(65) Prior Publication Data

US 2010/0045756 A1 Feb. 25, 2010

Related U.S. Application Data

(62) Division of application No. 11/485,606, filed on Jul. 12, 2006, now Pat. No. 7,648,232.

(51) Int. Cl.
*B41J 2/175* (2006.01)

(52) U.S. Cl. ..... 347/88; 347/14; 347/19; 347/99

(58) Field of Classification Search ..... 347/19, 347/88, 99, 5, 14

See application file for complete search history.

(56) References Cited

U.S. PATENT DOCUMENTS 5,038,157 A 8/1991 Howard
5,223,860 A 6/1993 Loofbourow et al.
5,442,387 A 8/1995 Loofbourow et al.
5,861,903 A 1/1999 Crawford et al.
5,975,688 A 11/1999 Kanaya et al.
6,056,394 A 5/2000 Rousseau et al.
6,213,600 B1 4/2001 Kobayashi et al.
6,761,443 B2 7/2004 Jones
6,840,613 B2 1/2005 Jones
6,924,835 B1 8/2005 Silverbrook et al.

(Continued)

FOREIGN PATENT DOCUMENTS

EP 1359014 A1 11/2003

(Continued)

OTHER PUBLICATIONS

EP Search Report, European Patent Office, Munich, DE, Sep. 19, 2007.

*Primary Examiner* — Matthew Luu
*Assistant Examiner* — Rut Patel
(74) *Attorney, Agent, or Firm* — Maginot, Moore & Beck, LLP

(57) ABSTRACT

A method of feeding ink sticks into an imaging device enables identification of data useful for device control. The method includes inserting at least one ink stick into an ink loader, the at least one ink stick including a plurality of code element patterns formed in the ink stick, each code element pattern having a plurality of code elements that include a first code element identifying a start of a code element pattern and a second code element identifying an end of the code element pattern, each code element pattern being configured to generate a same coded signal pattern; urging the ink stick toward a melt device; actuating at least one sensor in the imaging device with the plurality of code element patterns to generate a predetermined coded pattern of signals; and comparing the predetermined coded pattern of signals to identify a code word.

11 Claims, 8 Drawing Sheets

U.S. PATENT DOCUMENTS

| | | | | |
|---|---|---|---|---|
| 7,537,326 | B2 * | 5/2009 | Jones | 347/88 |
| 7,631,963 | B2 * | 12/2009 | Peters et al. | 347/88 |
| 7,682,010 | B2 * | 3/2010 | Lucas et al. | 347/99 |
| 7,753,510 | B2 * | 7/2010 | Titterington et al. | 347/88 |
| 7,874,661 | B2 * | 1/2011 | Tidrick | 347/88 |
| 7,963,645 | B2 * | 6/2011 | Rodriguez et al. | 347/88 |
| 7,971,980 | B2 * | 7/2011 | Jones et al. | 347/88 |
| 7,997,711 | B2 * | 8/2011 | Rodriguez et al. | 347/99 |
| 8,007,095 | B2 * | 8/2011 | Tidrick | 347/88 |
| 2005/0231584 | A1 * | 10/2005 | Rajaiah et al. | 347/232 |
| 2007/0080804 | A1 * | 4/2007 | Hirahara et al. | 340/572.1 |
| 2007/0146138 | A1 * | 6/2007 | Phipps et al. | 340/572.7 |
| 2007/0156628 | A1 * | 7/2007 | Rodriguez et al. | 707/1 |

FOREIGN PATENT DOCUMENTS

| | | | |
|---|---|---|---|
| EP | 1359015 | A1 | 11/2003 |
| EP | 1359024 | A1 | 11/2003 |
| EP | 1731315 | A1 | 12/2006 |

* cited by examiner

METHOD OF FEEDING SOLID INK STICKS INTO AN INK LOADER OF A PHASE CHANGE INK PRINTER

CLAIM OF PRIORITY

This application is a divisional application that claims priority from U.S. patent application Ser. No. 11/485,606, which is entitled Solid Ink Stick With Reliably Encoded Data and was filed on Jul. 12, 2006 and has issued as U.S. Pat. No. 7,648,232 on Jan. 19, 2010.

CROSS-REFERENCE TO RELATED APPLICATIONS

Reference is made to commonly-assigned copending U.S. patent application Ser. No. 11/473,610, entitled "Ink Loader for Interfacing with Solid Ink Sticks", Ser. No. 11/473,632, entitled "Solid Ink Stick with Interface Element", Ser. No. 11/473,656, entitled "Solid Ink Stick with Coded Sensor Feature" and Ser. No. 11/473,611, entitled "Solid Ink Stick with Enhanced Differentiation", all of which were filed on Jun. 23, 2006, the entire disclosures of which are expressly incorporated by reference herein.

TECHNICAL FIELD

This disclosure relates generally to phase change ink jet printers and the solid ink sticks used in such ink jet printers.

BACKGROUND

Solid ink or phase change ink printers conventionally receive ink in a solid form, either as pellets or as ink sticks. The solid ink pellets or ink sticks are placed in a feed chute of an ink loader and a feed mechanism in the ink loader delivers the solid ink to a heater assembly. Solid ink sticks are either gravity fed or urged by a spring through the feed chute toward a heater plate in the heater assembly. The heater plate melts the solid ink impinging on the plate into a liquid that is delivered to a print head for jetting onto a recording medium. U.S. Pat. No. 5,734,402 for a Solid Ink Feed System, issued Mar. 31, 1998 to Rousseau et al.; and U.S. Pat. No. 5,861,903 for an Ink Feed System, issued Jan. 19, 1999 to Crawford et al. describe exemplary systems for delivering solid ink sticks into a phase change ink printer.

One problem faced in solid ink technology is differentiation and identification of ink sticks to ensure the correct loading and compatibility of an ink stick with the imaging device in which it is used. The wrong color of ink stick in a feed channel, ink sticks intended for different solid ink printers, use of non-qualified ink, etc. may impact image quality or even damage the solid ink imaging device. In previously known phase change ink systems, differentiation and identification of ink sticks was accomplished by incorporating keying features into the exterior surface of an ink stick. These features acted to exclude inappropriately configured ink sticks from being inserted into a feed channel of the printer.

World markets with various pricing and color table preferences have created a situation where multiple ink types may exist in the market simultaneously with nearly identical size/shape ink and/or ink packaging. Thus, ink sticks may appear to be substantially the same but, in fact, may be intended for different phase change printing systems due to factors such as, for example, market pricing or color table. Due to the broad range of possible ink stick configurations, marketing strategies, pricing, etc., differentiating the inks sticks so only appropriate ink is accepted by a printer requires methods of identification that go beyond physical keying.

The nature of solid ink technology renders the addition of conventional labels or tagging mechanisms to an ink stick impractical. Tags and labels must be removed before the ink stick is melted. Otherwise the tag or label material would clog the liquid ink components. One method that has been implemented to aid in the identification of an ink stick by a printer control system is the incorporation of encoding features into the exterior surface of ink sticks that interact with sensors in the ink loader. Ink stick data may be encoded into these features by configuring the features to interact with one or more sensors in an ink loader to generate a signal or coded pattern of signals that corresponds to information specific to the ink stick. Due to the soft, waxy nature of an ink stick body, features formed into the exterior surface of the ink stick may be easily damaged and, consequently, encoded data may be lost. Therefore, encoding features were typically large to make them less susceptible to handling damage and to ensure accurate reading by the sensor system in the ink loader. Larger features limit the information content that may be incorporated into an ink stick. The use of smaller encoding features that allow more information to be embedded into an ink stick, however, increases the likelihood of information corruption and incorrect sensing or reading due to the vulnerability of the soft ink material.

SUMMARY

A method of feeding ink sticks into an imaging device enables identification of data useful for device control. The method includes inserting at least one ink stick into an ink loader, the at least one ink stick including a plurality of code element patterns formed in the ink stick, each code element pattern having a plurality of code elements that include a first code element identifying a start of a code element pattern and a second code element identifying an end of the code element pattern, each code element pattern being configured to generate a same coded signal pattern; urging the ink stick toward a melt device; actuating at least one sensor in the imaging device with the plurality of code element patterns to generate a predetermined coded pattern of signals; and comparing the predetermined coded pattern of signals to identify a code word.

DETAILED DESCRIPTION OF THE PREFERRED EMBODIMENT

Figure 1:
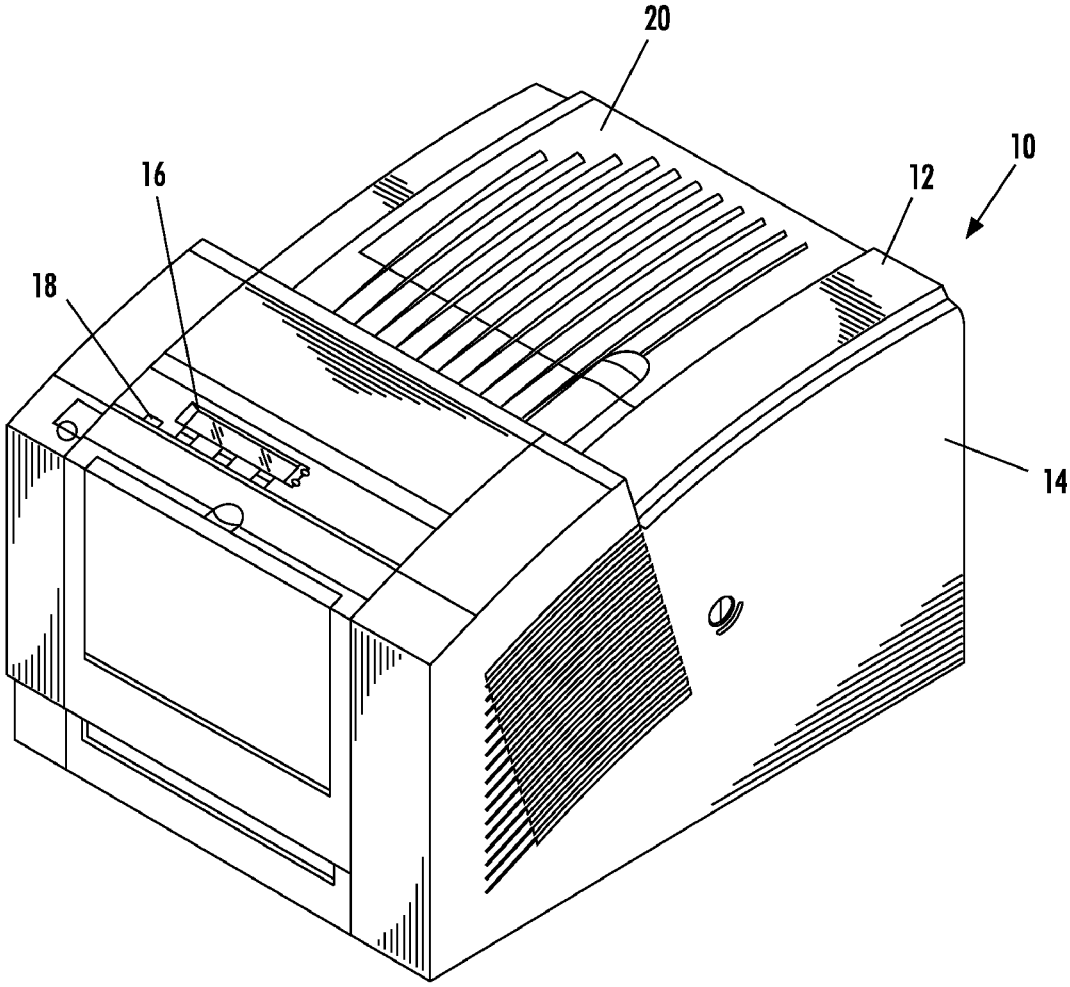
FIG. 1 is a perspective view of a phase change printer with the printer top cover closed.

For a general understanding of the present embodiments, reference is made to the drawings. In the drawings, like reference numerals have been used throughout to designate like elements.

FIG. 1 shows a solid ink, or phase change, ink printer 10 that includes an outer housing having a top surface 12 and side surfaces 14. A user interface, such as a front panel display screen 16, displays information concerning the status of the printer, and user instructions. Buttons 18 or other control elements for controlling operation of the printer are adjacent the front panel display screen, or may be at other locations on the printer. An ink jet printing mechanism (not shown) is contained inside the housing. An example of the printing mechanism is described in U.S. Pat. No. 5,805,191, entitled Surface Application System, to Jones et al., and U.S. Pat. No. 5,455,604, entitled Ink Jet Printer Architecture and Method, to Adams et al. An ink loader delivers ink to the printing mechanism. The ink loader is contained under the top surface of the printer housing. The top surface of the housing includes a hinged ink access cover 20 that opens as shown in FIG. 2, to provide the operator access to the ink loader.

Figure 2:
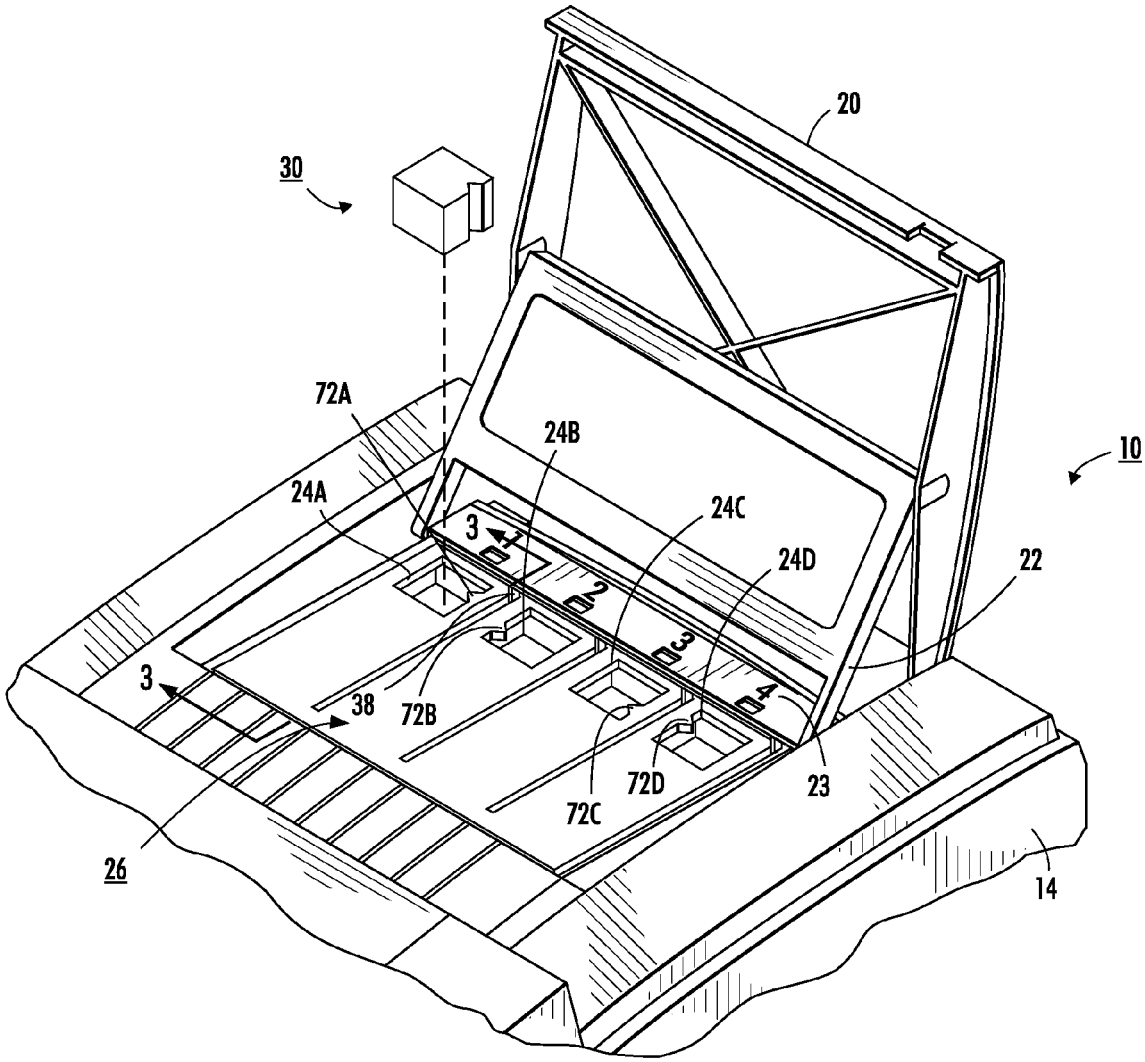
FIG. 2 is an enlarged partial top perspective view of the phase change printer with the ink access cover open, showing a solid ink stick in position to be loaded into a feed channel.
Figure 3:
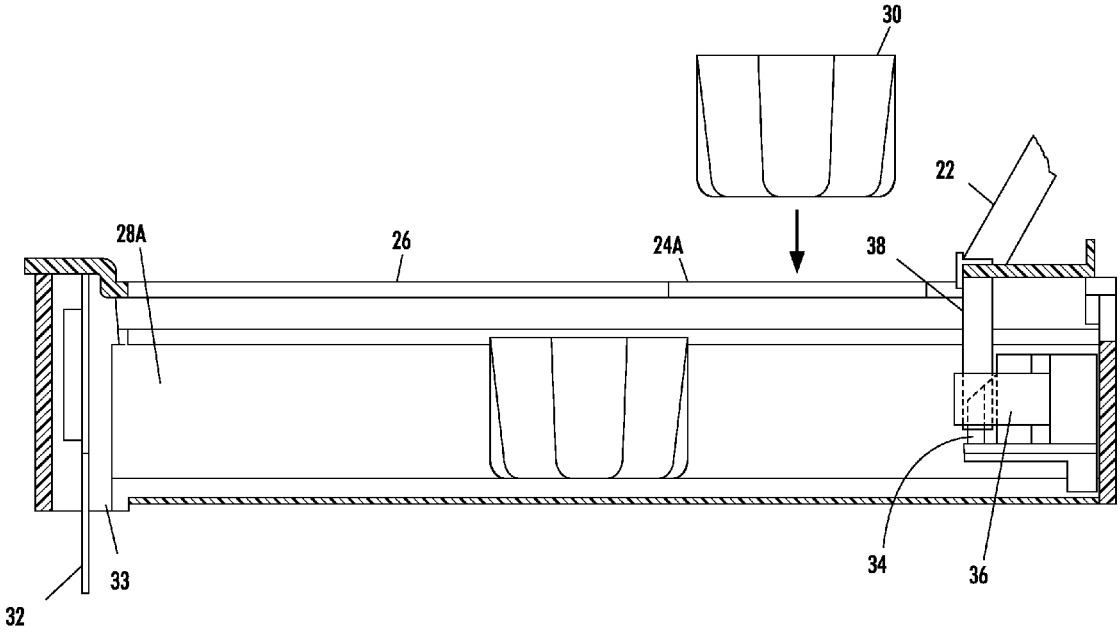
FIG. 3 is a side sectional view of a feed channel of a solid ink feed system taken along line 3-3 of FIG. 2.

FIG. 2 illustrates the printer 10 with its ink access cover 20 raised revealing an ink load linkage element 22 and an ink stick feed assembly or ink loader. In the particular printer shown, the ink access cover 20 is attached to an ink load linkage element 22 so that when the printer ink access cover 20 is raised, the ink load linkage 22 slides and pivots to an ink load position. The interaction of the ink access cover and the ink load linkage element is described in U.S. Pat. No. 5,861,903 for an Ink Feed System, issued Jan. 19, 1999 to Crawford et al. As seen in FIG. 2, the ink loader includes a key plate 26 having keyed openings 24. Each keyed opening 24A, 24B, 24C, 24D provides access to an insertion end of one of several individual feed channels 28A, 28B, 28C, 28D of the ink loader (see FIG. 3).

Each longitudinal feed channel 28 of the ink loader delivers ink sticks 30 of one particular color to a corresponding melt plate 32. Each feed channel has a longitudinal feed direction from the insertion end of the feed channel to the melt end of the feed channel. The melt end of the feed channel is adjacent the melt plate. The melt plate melts the solid ink stick into a liquid form. The melted ink drips through a gap 33 between the melt end of the feed channel and the melt plate, and into a liquid ink reservoir (not shown). The feed channels 28A, 28B, 28C, 28D (see FIG. 3) have a longitudinal dimension from the insertion end to the melt end, and a lateral dimension, substantially perpendicular to the longitudinal dimension.

Each feed channel 28 in the particular embodiment illustrated includes a push block 34 driven by a driving force or element, such as a constant force spring 36 to push the individual ink sticks along the length of the longitudinal feed channel toward the melt plates 32 that are at the melt end of each feed channel. The tension of the constant force spring 36 drives the push block 34 toward the melt end of the feed channel. In a manner similar to that described in U.S. Pat. No. 5,861,903, the ink load linkage 22 is coupled to a yoke 38, which is attached to the constant force spring mounted in the push block. The attachment to the ink load linkage 22 pulls the push block 34 toward the insertion end of the feed channel when the ink access cover is raised to reveal the key plate 26. In the implementation illustrated, the constant force spring 36 can be a flat spring with its face oriented along a substantially vertical axis.

A color printer typically uses four colors of ink (yellow, cyan, magenta, and black). Ink sticks 30 of each color are delivered through a corresponding individual one of the feed channels 28A, 28B, 28C, 28D. The operator of the printer exercises care to avoid inserting ink sticks of one color into a feed channel for a different color. Ink sticks may be so saturated with color dye that it may be difficult for a printer operator to tell by the apparent color alone which color is which. Cyan, magenta, and black ink sticks in particular can be difficult to distinguish visually based on color appearance. The key plate 26 has keyed openings 24A, 24B, 24C, 24D to aid the printer operator in ensuring that only ink sticks of the proper color are inserted into each feed channel. Each keyed opening 24A, 24B, 24C, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 4:
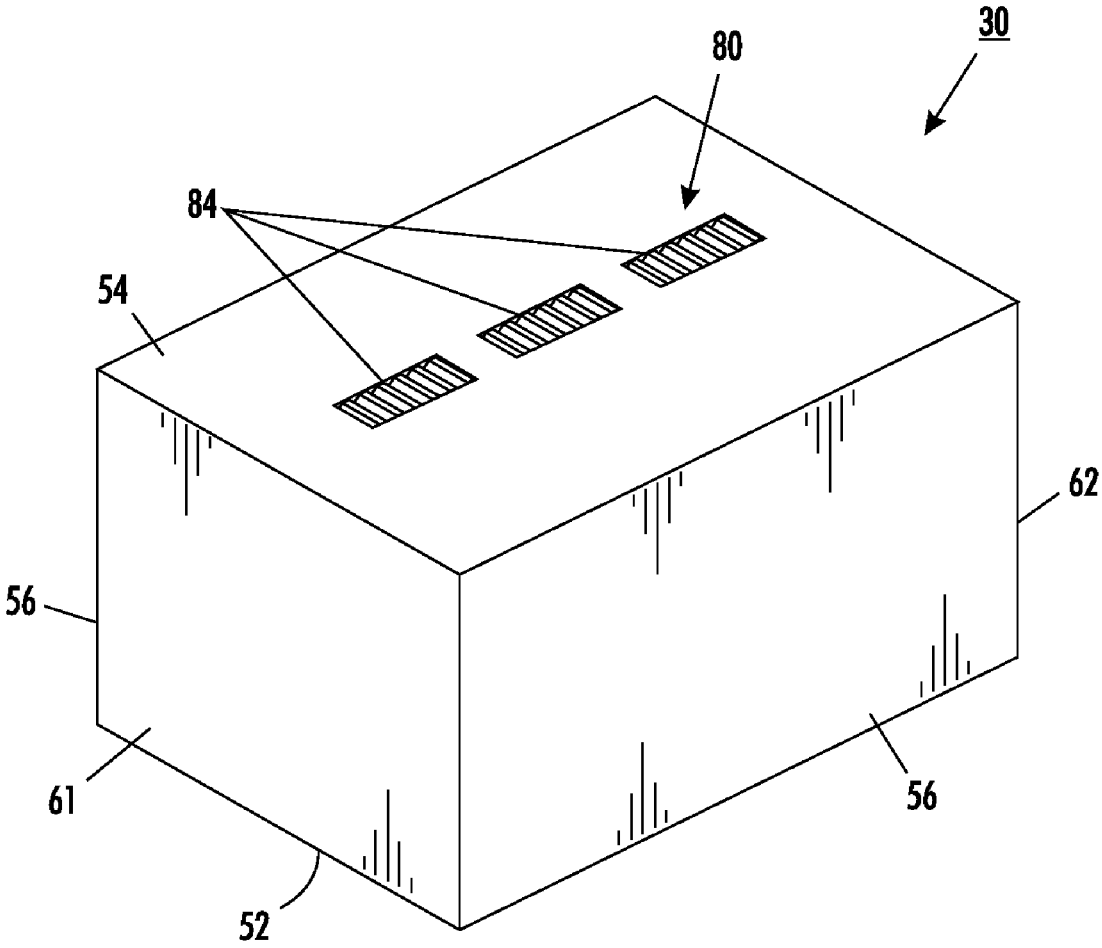
FIG. 4 is a perspective view of one embodiment of a solid ink stick with a coded sensor feature.

An exemplary solid ink stick 30 for use in the ink loader is illustrated in FIG. 4. The ink stick is formed of a three dimensional ink stick body. The ink stick body illustrated has a bottom exemplified by a generally bottom surface 52 and a top exemplified by a generally top surface 54. The particular bottom surface 52 and top surface 54 illustrated are substantially parallel one another, although they can take on other contours and relative relationships. Moreover, the surfaces of the ink stick body need not be flat, nor need they be parallel or perpendicular one another.

The ink stick body also has a plurality of side extremities, such as side surfaces 56 and end surfaces 61, 62. The illustrated embodiment includes four side surfaces, including two end surfaces 61, 62 and two lateral, side surfaces 56. The basic elements of the lateral side surfaces 56 are substantially parallel one another, and are substantially perpendicular to the top and bottom surfaces 52, 54. The end surfaces 61, 62 are also basically substantially parallel one another, and substantially perpendicular to the top and bottom surfaces, and to the lateral side surfaces. One of the end surfaces 61 is a leading end surface, and the other end surface 62 is a trailing end surface. The ink stick body may be formed by pour molding, injection molding, compression molding, or other known techniques.

Referring again to FIG. 4, the ink stick may include one or more coded sensor features 80 for encoding variable control information or attribute information into the ink stick 30. To encode the information into the surface of an ink stick, the coded sensor feature 80 comprises a plurality of code element patterns 84 formed in predetermined locations on the exterior surface of an ink stick that correspond to sensor locations in the ink loader (See FIG. 5). The code elements 86 of each code element pattern are configured to actuate one or more sensors in the ink loader in a predetermined manner such that a code element pattern generates a coded signal pattern that corresponds to the encoded control information or attribute information. As used herein, a code element pattern may comprise the number, arrangement or configuration of code elements for generating the coded signal pattern.

Each code element 86 may be curved, spherical, angled, square or any shape that permits reliable sensor actuation, directly or indirectly, such as by moving a flag or actuator or using an optical sense system. For example, the code elements in FIG. 5 have angled surfaces configured to reflect light from an optical source onto an optical detector. Alternatively, each code element may be configured to actuate one or more sensors based on a physical dimension of the code element, such as, for example, depth, length, width or spacing between elements or any combination of dimensional features.

The number and positioning of code element patterns 84 that may be placed on an ink stick is limited only by the geometry of the ink sticks and sensor placement options. In one embodiment, a code element pattern may comprise one or more generally linear arrays of code elements forming a path substantially parallel to the feed direction that may be read as the ink stick is urged along a feed channel by a push block or gravity. The code elements forming the pattern, however, may have any suitable arrangement, pattern, or the like, including arrays perpendicular to the feed direction, concentric rings, etc. Code element patterns 84 may be beneficially placed in a location on the exterior surface of an ink stick where damage associated with typical stick handling does not degrade the integrity of the code element patterns such as, for example, a recess or inset portion in the exterior surface of the ink stick.

In one embodiment, information may be encoded into a coded sensor feature 80 by selecting at least one unique identifier, or code word, to be indicated by a coded sensor feature 80 and configuring or arranging the plurality of code elements to actuate sensors to generate a coded pattern of signals that corresponds to the selected code word(s). A code word may comprise one or more values, alphanumeric characters, symbols, etc. that may be associated with a meaning by an imaging device control system. The code word may be assigned to indicate control and/or attribute information that pertains to an ink stick. The code word may be read by an imaging device control system and translated into the control and/or attribute information pertaining to the ink stick that may be used in a number of ways by the control system. The control system may use the code word as a lookup key for accessing data stored in a data structure, such as, for example, a database or table. The data stored in the data structure may comprise a plurality of possible code words with associated information corresponding to each code word.

Figure 5:
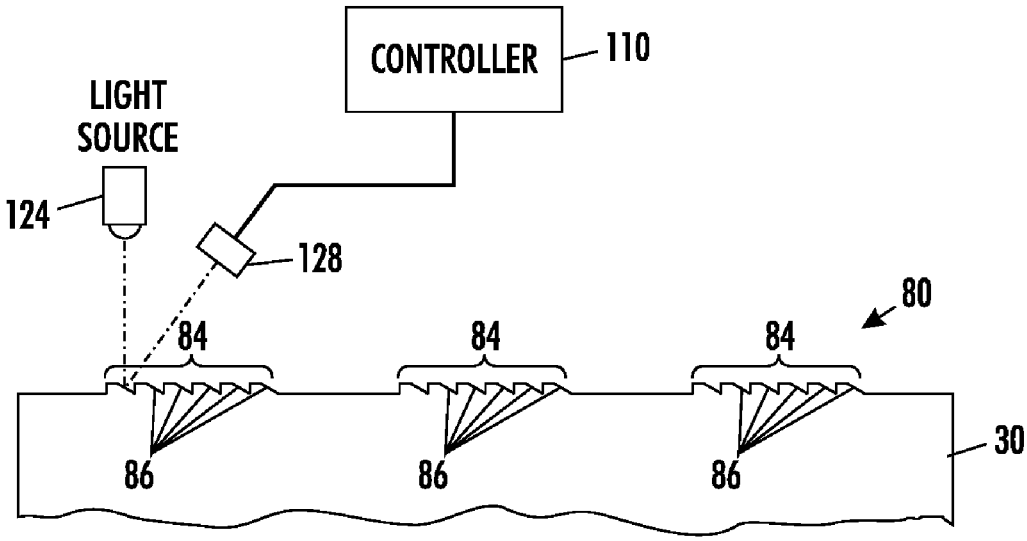
FIG. 5 is a side schematic view of a coded sensor feature and a sensor system for reading the coded sensor feature in which a sensor of the sensor system is being actuated by a code element.

FIG. 5 shows an embodiment of a sensor system 120 for reading the coded sensor feature 80. In this embodiment, the sensor system 120 includes an optical source 124 and an optical sensor 128. The optical source 124 may comprise a light emitting diode (LED) or laser diode and a collimating lens which collimates the beam 130 emitted from the LED or laser diode toward a focus point in which the beam impinges on the coded sensor feature 80 of the ink stick. The optical sensor 128 may comprise a photodiode which converts detected light to electrical signals. The optical sensor 128 may include an amplifier (not shown) for amplifying the detected signal and an optical filter (not shown) tuned to the wavelength of light emitted by the optical source 124 for eliminating stray light. While the optical sensor 128 described comprises a photodiode, other types of light sensors, such as, for example, photo-conductors, may be employed.

Figure 6:
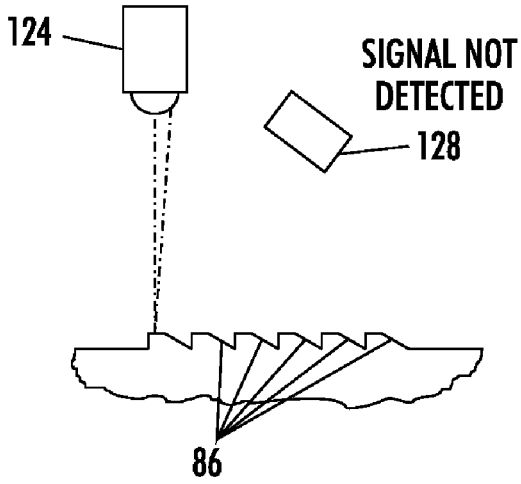
FIG. 6 is a side schematic view of a portion of the coded sensor feature and a sensor system of FIG. 5 in which a sensor of the sensor system is not being actuated by a code element.

Referring to FIG. 5, the optical source 124 and optical sensor 128 are oriented such that light emitted from optical source 124 is detected by optical sensor 128 when a code element is in an operative position beneath the optical source. This provides for the optical sensor 128 to be stimulated by light being scattered by the surface of the code elements. When a code element is not in an operative position, as shown in FIG. 6, light may not be detected by optical sensor 128. In the embodiment of FIG. 5, the optical source 124 and the optical sensor 128 are fixedly mounted in an ink loader in a position for the optical source to direct the light beam 88 onto a coded marker 70 of an ink stick as the ink stick 30 is loaded or transported along a feed path. The optical source 124 and the optical sensor 128 may be located at any point along the path of movement of the ink stick 30 and could be mounted to the loader or other structure of the print device. Coded sensor features 80 may be read during insertion or as the ink stick moves forward in the feed channel. Code reading in the channel may occur one or more times at one or more positions along the path of travel of the ink stick. Scanning or moving a sensor device over the code elements with the ink in a stationary position may be done as an alternative to reading the code while the ink is in motion, such as during inserted or fed. In yet another configuration, a combination of stationary and moving stick code reading could be done.

In one embodiment, the bit pattern, or code word, of the binary signal may then be determined by the controller 110. The code word may be translated by the controller 110 into information that may be used in a number of ways by the control system of a printer. For example, the controller 110 may compare the reference signal to the data stored in the data structure, or table, stored in memory. The data stored in the data structure may comprise a plurality of possible code words with associated information corresponding to code word. The associated information may comprise control and/or attribute information that pertains to an ink stick such as, for example, ink stick color, printer compatibility, ink stick composition information, or may comprise printer calibration information pertaining to the ink stick, such as, for example, suitable color table, thermal settings, etc. that may be used with an ink stick. The control and/or attribute information may be used by a controller 110 in a suitably equipped phase change ink jet printing device to control imaging operations. For example, the control system 110 may enable or disable operations, optimize operations or influence or set operation parameters based on the "associated information" that corresponds to the code word encoded in a coded marker.

In order preserve the integrity of the data incorporated in a coded sensor feature, the code element pattern for generating a coded signal pattern corresponding to the code word is repeated. The pattern repetition reduces the likelihood that damage that may occur during typical stick handling does not destroy the data encoded into the coded sensor feature. Similarly, occasional imperfections that may occur during manufacture or packaging need not impair the ability of the imaging system to correctly identify and respond to the ink by comparing information in the repetitive code pattern. The data is preserved by repeating the pattern in the exterior surface of the ink stick so that damage to one pattern does not result in the loss of data encoded into the coded sensor feature. For example, if one of the patterns of code elements becomes corrupted, the redundant code element patterns increases the likelihood of an accurate reading of the code word and reduces the chances of an inaccurate reading of the code due to imperfectly formed or damaged code elements, or inconsistent feed rate of the ink stick. A repeated pattern or repetition of the pattern comprises a repetition of the number, arrangement and/or configuration of code elements on the surface of the ink stick in order to generate the coded pattern of signals n times where n corresponds to the number of times the pattern is repeated.

The pattern of code elements may be repeated any suitable number of times. The number of repetitions that may be incorporated into the coded sensor feature is limited only by the geometry of the ink sticks and sensor placement options in an ink loader. The imaging device control system may be configured to weigh the pattern readings such that pattern readings that occur the most are given more weight, and hence, are more likely to indicate the code word. For example, a pattern reading that occurs three times may be given more weight than a pattern reading that occurs two or less times.

Redundancy of a pattern may be incorporated in the coded sensor feature in a number of ways. For example, the pattern of code elements may be formed on more than one side of the ink stick. Similarly, the pattern may be repeated on the same surface of the ink stick linearly, side by side, interleaved, etc., or any combination of these. FIG. 5 shows an embodiment of a coded sensor feature in which the code element pattern 84 is repeated linearly. As shown, each group of code elements is configured to actuate one or more sensors to generate the same coded pattern of signals that indicates a code word. It may be desirable to repeat the pattern of code elements in multiple ways on one product and in different ways on different products based on the ink stick size and configuration and sensing component placement opportunities.

Figure 7:
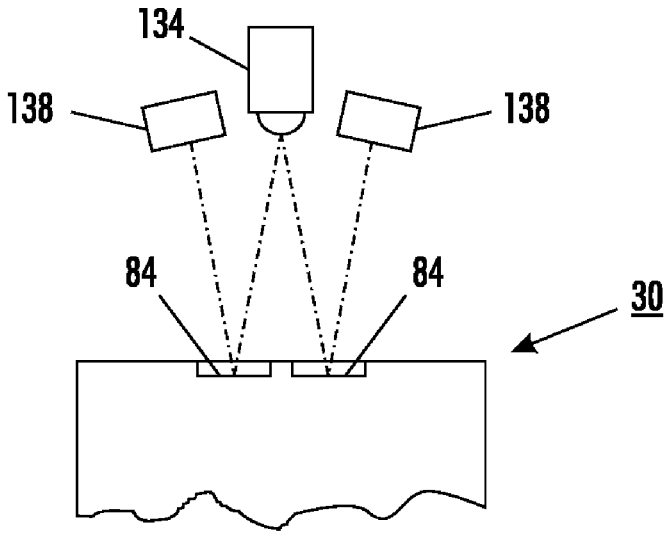
FIG. 7 is a front view of a coded sensor feature having dual track redundancy.

Referring now to FIG. 7, there is shown a front view of an embodiment of a coded sensor feature 80 having dual track redundancy. In this embodiment, two or more code patterns 84 are placed side by side on a surface of an ink stick 30. The code patterns 84 of each track may be repeated linearly as shown in FIG. 5 in order to further ensure the reliability of reading the correct pattern. In one embodiment, the dual track sensor feature 80 may be read by a sensor system comprising a single optical source 134 for directing light onto the dual tracks 84 as the ink stick 30 is urged along a feed channel and a pair of optical sensors 138 positioned in the feed channel to detect light reflected from the code elements. Although a single optical source 134 and dual optical sensors 138 are shown, any suitable arrangement of sensors or configuration of sensors may be employed.

Figure 8:
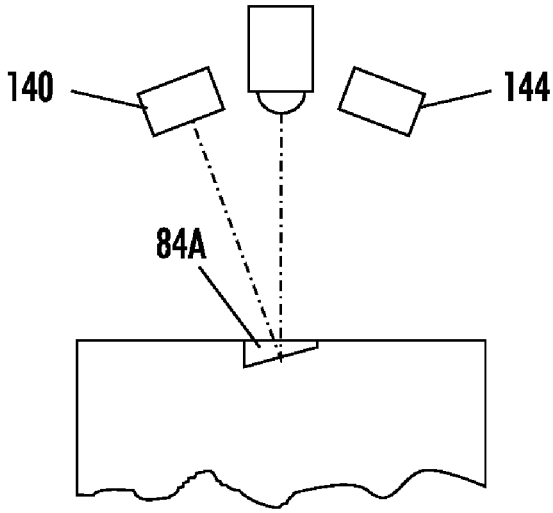
FIG. 8 is a front view of a coded sensor feature having single track, alternating pattern redundancy in which a first code element of a first pattern is shown actuating a sensor.
Figure 9:
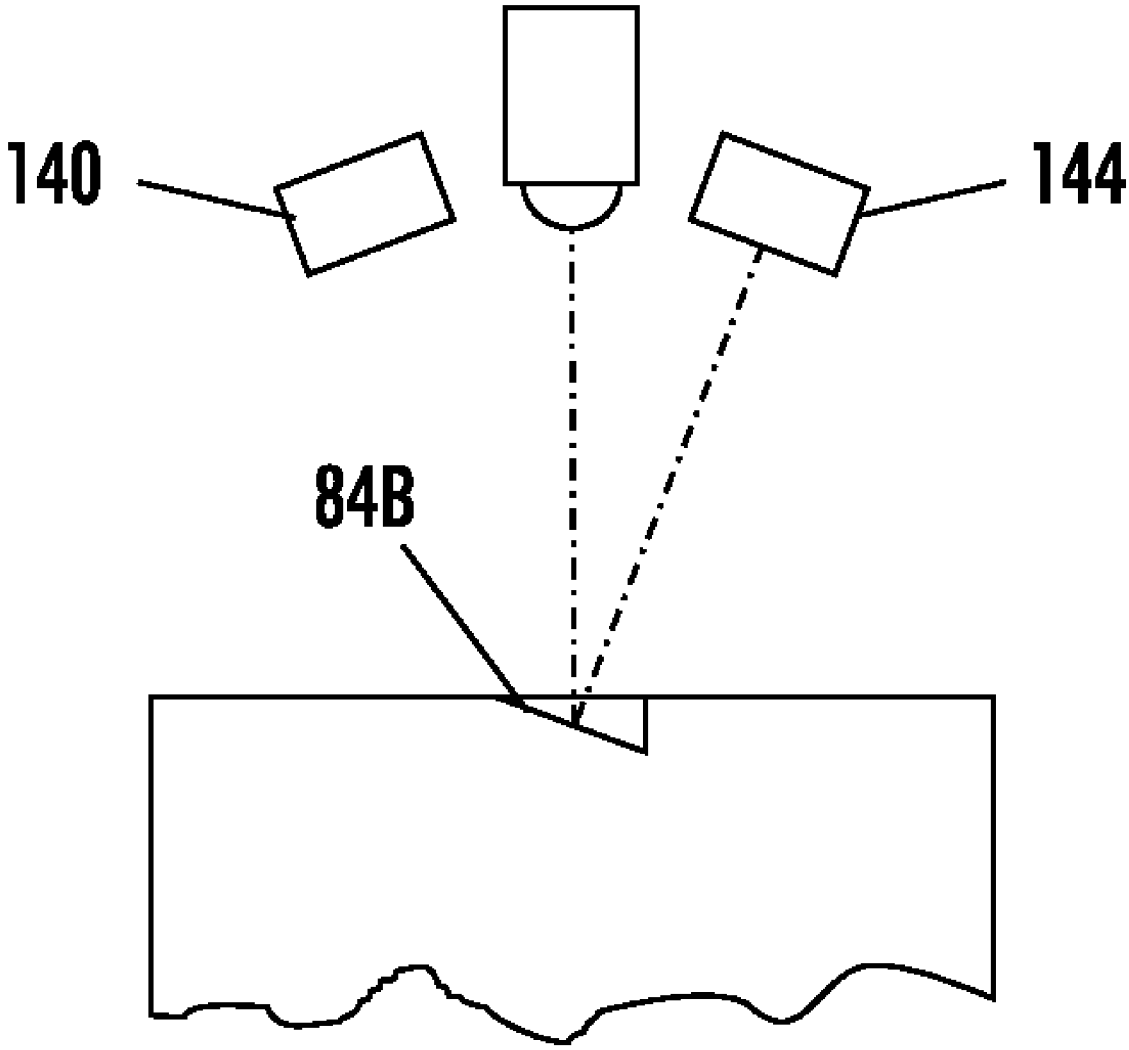
FIG. 9 is a front view of the coded sensor feature of FIG. 8 showing a subsequent element of the interleaved code pattern actuating a sensor.

Referring to FIGS. 8 and 9, there is shown an embodiment of a coded sensor feature 80 having single track, alternating pattern redundancy. In this embodiment, redundant code patterns 84 are interleaved into a single track. For example, as shown in FIG. 8, a first code element pattern 84A may have angled surfaces configured to reflect light onto a first sensor 140. As shown in FIG. 9, a second code element pattern 84B may have angled surfaces configured to reflect light onto a second sensor 144.

Figure 10:
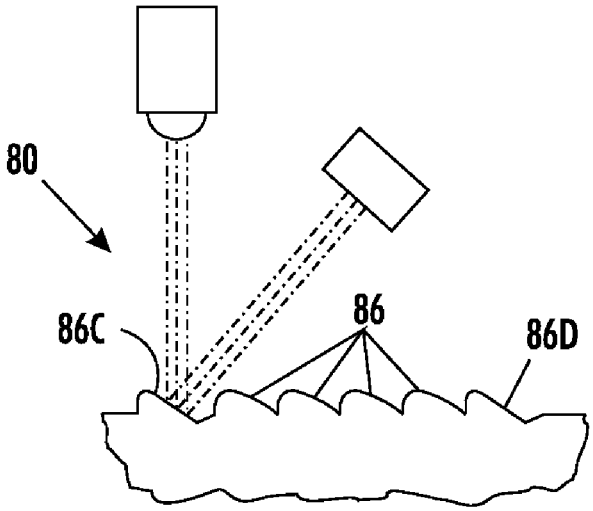
FIG. 10 is a side view of a code element pattern having start/stop indicators.
Figure 11:
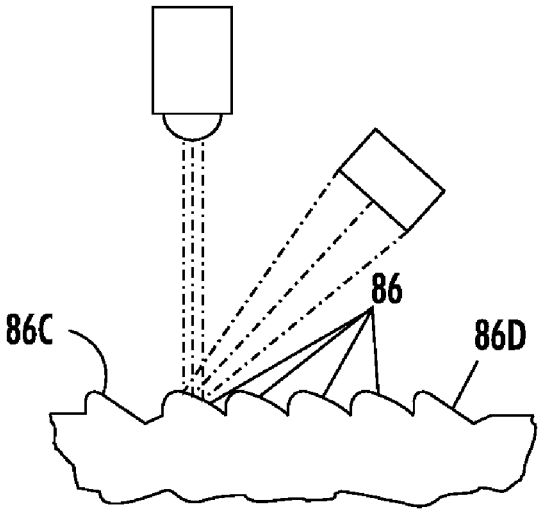
FIG. 11 is another side view of a code element pattern having start/stop indicators.

Another feature that may be implemented in a coded sensor feature to enhance the reliability and accuracy of code reading comprises incorporating start/end indicators into the coded sensor feature to indicate the start and/or end of a pattern of code elements. For example, in one embodiment, redundant code elements may be placed at the beginning and/or end of a pattern of code elements that are configured to actuate a sensor that may be assigned to indicate to the control system the start and/or end of a pattern. These start/end or transition indicator elements could be unique in the pattern of code elements but common to each repeating segment or could be unique in each repeating segment, such as indicating an incrementing location for that segment along the length of an ink stick. In another embodiment, the first and/or last code elements of a pattern of code elements may be configured to actuate a sensor at a different amplitude than the intermediate code elements of the pattern, thus, indicating the beginning/end of the pattern. As an example, FIG. 10 shows an embodiment of a coded sensor feature 80 in which the first 84C and last code element 84D of the pattern has a flat surface while the intermediate code elements 84 have curved surfaces. The code elements 84C, 84D having flat surfaces may reflect light at a different intensity than the code elements 84 having curved surfaces. Thus, the curved and flat surfaces of the code elements may generate signals having different amplitudes enabling a controller to determine the beginning and/or ending of a sequence of code elements based on the amplitude of the signal generated by a particular code element.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of feeding ink sticks in an ink loader of a phase change ink imaging device, the method comprising:

inserting at least one ink stick into an ink loader of a phase change ink imaging device, the at least one ink stick including a plurality of code element patterns formed in an exterior surface of the ink stick, each code element pattern having a plurality of code elements that include a first code element identifying a beginning of a code element pattern and a second code element identifying an end of a code element pattern, each code element pattern being configured to generate a same coded signal pattern;

urging the ink stick toward a melt device;

actuating at least one sensor in the imaging device with the plurality of code element patterns to generate a predetermined coded pattern of signals; and comparing the predetermined coded pattern of signals to identify a code word.

2. The method of claim 1, wherein the code word corresponds to variable control/attribute information pertaining to the at least one ink stick.

3. The method of claim 2 further comprising:

controlling imaging operations with reference to the variable control/attribute information corresponding to the identified code word.

4. The method of claim 3, wherein controlling imaging operations comprises generating an alert message in response to the control/attribute information indicating the ink stick is not intended for use in the phase change imaging device.

5. The method of claim 3, the control of imaging operations includes:

disabling imaging operations.

6. The method of claim 3, the control of imaging operations includes:

enabling imaging operations.

7. The method of claim 3, the control of imaging operations includes:

setting parameters for the imaging operations with reference to the identified code word.

8. The method of claim 1, wherein comparing the plurality of coded signal patterns to identify a code word comprises:

identifying a coded signal pattern that is generated most often by the plurality of code element patterns as the code word.

9. The method of claim 1 further comprising:

detecting the first code element and the second code element as being unique with reference to the pattern of code elements.

10. The method of claim 1 further comprising:

directing light at a code element pattern;

reflecting the directed light to the sensor at one intensity with the first code element and the second code element; and reflecting the directed light to the sensor at a different intensity with the other code elements in the code element pattern.

11. The method of claim 1 further comprising:

accessing data with reference to the identified code word.

* * * * *